US011365702B2

(12) United States Patent
Li

(10) Patent No.: US 11,365,702 B2
(45) Date of Patent: Jun. 21, 2022

(54) CAMSHAFT COVER, CAMSHAFT ASSEMBLY, AND DOUBLE-CYLINDER ENGINE

(71) Applicant: SEGWAY TECHNOLOGY CO., LTD., Jiangsu (CN)

(72) Inventor: Li Li, Jiangsu (CN)

(73) Assignee: SEGWAY TECHNOLOGY CO., LTD., Changzhou (CN)

( * ) Notice: Subject to any disclaimer, the term of this patent is extended or adjusted under 35 U.S.C. 154(b) by 0 days.

(21) Appl. No.: 17/226,439

(22) Filed: Apr. 9, 2021

(65) Prior Publication Data

US 2021/0317797 A1 Oct. 14, 2021

(30) Foreign Application Priority Data

Apr. 9, 2020 (CN) ..... 202020515152.6

(51) Int. Cl.

| | |
|---|---|
| ***F02F 7/00*** | (2006.01) |
| ***F01L 1/047*** | (2006.01) |
| ***F01M 1/06*** | (2006.01) |
| ***F01M 9/10*** | (2006.01) |
| ***F01M 11/02*** | (2006.01) |

(52) U.S. Cl.

CPC ..... *F02F 7/006* (2013.01); *F01L 1/047* (2013.01); *F01M 1/06* (2013.01); *F01M 9/10* (2013.01); *F01M 9/102* (2013.01); *F01M 9/105* (2013.01); *F01M 11/02* (2013.01); *F01L 2001/0476* (2013.01); *F01M 2001/064* (2013.01)

(58) Field of Classification Search

USPC ..... 123/193.5, 90.27, 90.38, 195 C

See application file for complete search history.

(56) References Cited

U.S. PATENT DOCUMENTS

| | | | | |
|---|---|---|---|---|
| RE35,382 E * | 11/1996 | Saito | F01L 1/053 | 123/90.27 |
| 6,513,474 B2 | 2/2003 | Yoon | | |
| 7,059,291 B2 * | 6/2006 | Ueno | F02F 1/38 | 123/193.5 |
| 7,574,991 B2 * | 8/2009 | Kumagai | F02F 7/006 | 123/195 C |
| 8,590,499 B2 * | 11/2013 | Ilgeroth | F02F 7/006 | 123/90.27 |

(Continued)

FOREIGN PATENT DOCUMENTS

| | | | |
|---|---|---|---|
| JP | S63-176612 A | 7/1988 | |
| JP | 03286109 A * | 12/1991 | F01M 9/10 |

(Continued)

OTHER PUBLICATIONS

European Extended Search Report dated Aug. 26, 2021 for Application No. 21167666.3, 7 pages.

*Primary Examiner* — Devon C Kramer
*Assistant Examiner* — Wesley G Harris
(74) *Attorney, Agent, or Firm* — Frost Brown Todd LLC

(57) ABSTRACT

A camshaft cover, a camshaft assembly, and a double-cylinder engine are provided. The camshaft cover has an integral structure, and includes a first shaft cover portion, a second shaft cover portion, a first connecting portion and a second connecting portion. The first connecting portion and the second connecting portion are connected between the first shaft cover portion and the second shaft cover portion, and spaced apart axially.

12 Claims, 3 Drawing Sheets

(56) References Cited

U.S. PATENT DOCUMENTS

| | | | | |
|---|---|---|---|---|
| 2002/0185094 | A1* | 12/2002 | Yoon | F02F 7/006<br>123/90.38 |
| 2004/0144349 | A1* | 7/2004 | Wampula | F02F 7/006<br>123/90.38 |

FOREIGN PATENT DOCUMENTS

| | | | |
|---|---|---|---|
| JP | H04-22702 | A | 1/1992 |
| WO | WO 2007/083223 | A1 | 7/2007 |

* cited by examiner

CAMSHAFT COVER, CAMSHAFT ASSEMBLY, AND DOUBLE-CYLINDER ENGINE

CROSS-REFERENCE TO RELATED APPLICATION

This application is based on and claims priority to Chinese Patent Application No. 202020515152.6, filed on Apr. 9, 2020, the entire content of which is incorporated herein by reference.

FIELD

The present disclosure relates to a technical field of engines, and particularly to a camshaft cover, a camshaft assembly, and a double-cylinder engine.

BACKGROUND

In the related art, a camshaft cover of an in-line double-cylinder engine generally is designed into a split structure. As shown in FIG. 5, the camshaft cover 200 includes a first part 201, a second part 202 and a third part 203. Although the parts are easy to shape after being produced independently, each part needs a mold and a clamp, which results in large development investment and a relatively complicated mounting process.

SUMMARY

The present disclosure seeks to solve at least one of the problems existing in the related art. To this end, an object of the present disclosure is to propose a camshaft cover for a double-cylinder engine, which has an integral structure and may reduce investment and assembling difficulties.

Embodiments of the present disclosure further propose a camshaft assembly for a double-cylinder engine.

Embodiments of the present disclosure further propose a double-cylinder engine.

The camshaft cover for the double-cylinder engine according to embodiments of the present disclosure has an integral structure, and includes a first shaft cover portion, a second shaft cover portion, a first connecting portion and a second connecting portion. The first connecting portion and the second connecting portion are connected between the first shaft cover portion and the second shaft cover portion, and spaced apart axially.

The camshaft assembly for the double-cylinder engine according to embodiments of the present disclosure includes: a first camshaft having an axis; a second camshaft having an axis parallel to the axis of the first camshaft; and a camshaft cover. The camshaft cover includes a first shaft cover portion, a second shaft cover portion, a first connecting portion and a second connecting portion which are integrally formed. The first connecting portion and the second connecting portion are spaced apart axially, and connected between the first shaft cover portion and the second shaft cover portion. The first shaft cover portion covers the first camshaft, and the second shaft cover portion covers the second camshaft.

The double-cylinder engine according to embodiments of the present disclosure includes a camshaft assembly. The camshaft assembly includes: a first camshaft having an axis; a second camshaft having an axis parallel to the axis of the first camshaft; and a camshaft cover. The camshaft cover has an integral structure, and includes a first shaft cover portion, a second shaft cover portion, a first connecting portion and a second connecting portion. The first connecting portion and the second connecting portion are connected between the first shaft cover portion and the second shaft cover portion, and spaced apart axially. The first shaft cover portion covers the first camshaft, and the second shaft cover portion covers the second camshaft.

Additional aspects and advantages of the present disclosure will be given in part in the following descriptions, become apparent in part from the following descriptions, or be learned from the practice of the present disclosure.

BRIEF DESCRIPTION OF DRAWINGS

The above and/or additional aspects and advantages of the present disclosure will become apparent and more readily appreciated from the following descriptions made with reference to the drawings.

DETAILED DESCRIPTION

Descriptions will be made in detail to embodiments of the present disclosure, and the embodiments described herein with reference to drawings are illustrative. Descriptions will be made in detail to embodiments of the present disclosure.

A camshaft assembly 100 according to an embodiment of the present disclosure will be described below with reference to FIGS. 1 to 4, and the camshaft assembly 100 may be applied to a double-cylinder engine which may be used in an all-terrain vehicle.

Figure 1:
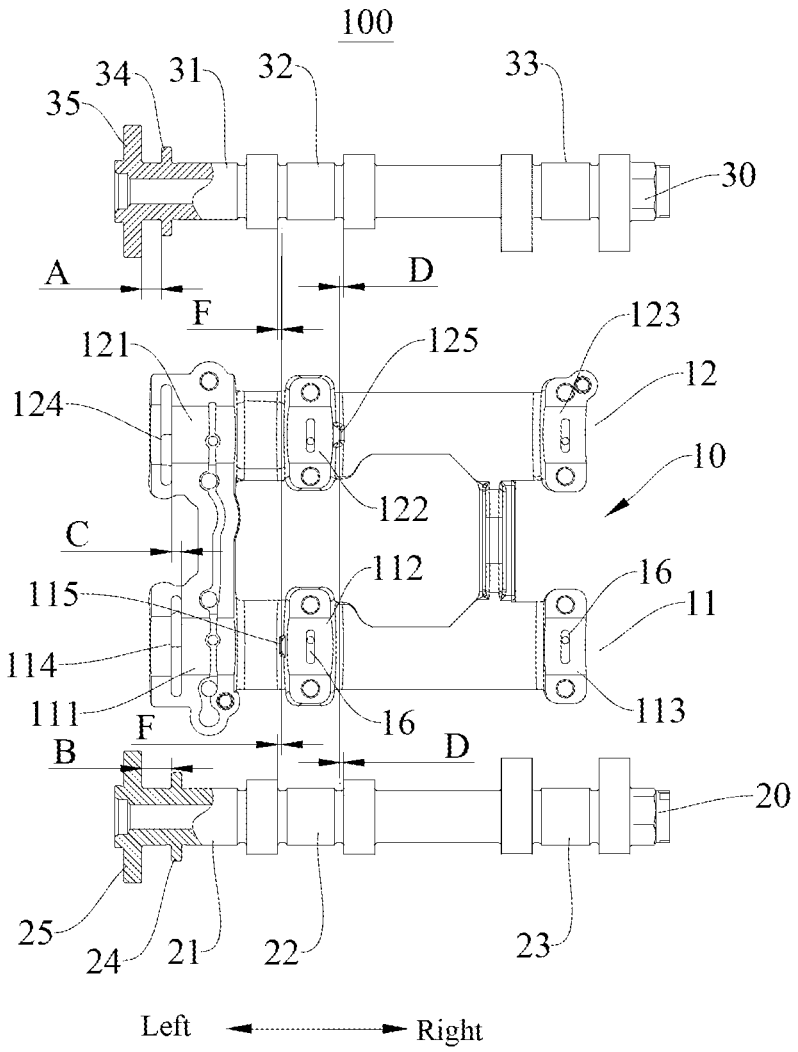
FIG. 1 is an expanded view of a camshaft assembly according to an embodiment of the present disclosure.

As shown in FIG. 1, the camshaft assembly 100 according to the embodiment of the present disclosure includes a first camshaft 20, a second camshaft 30 and a camshaft cover 10. The camshaft cover 10 is arranged on the first camshaft 20 and the second camshaft 30, and may achieve protecting and fixing functions above the first camshaft 20 and the second camshaft 30.

As shown in FIG. 1, the first camshaft 20 has at least two journals, for example, three journals, i.e., a first journal 21, a second journal 22 and a third journal 23, the second camshaft 30 has an axis parallel to an axis of the first camshaft 20, both axes extend in a left-right direction, and the second camshaft 30 has at least two journals, for example, three journals, i.e., a fourth journal 31, a fifth journal 32 and a sixth journal 33. The journals and cams of the camshafts are alternated on both camshafts, for example, the journal may be connected between two cams. Specifically, the second journal 22 is connected between two cams, and the third journal 23 is also connected between two cams. For another example, the journal may also be connected to a side of the cam. Specifically, the first journal 21 is connected to a side of the cam. The first camshaft 20 may be configured as an exhaust camshaft, and the second camshaft 30 may be configured as an intake camshaft.

Figure 2:
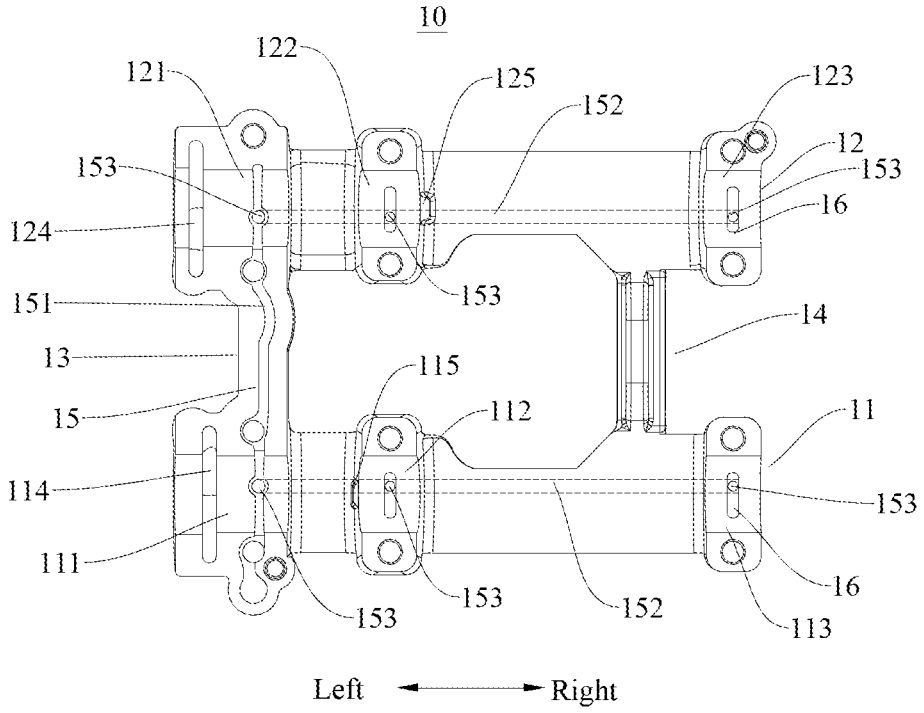
FIG. 2 is a schematic diagram of a camshaft cover according to an embodiment of the present disclosure.

As shown in FIGS. 1 and 2, the camshaft cover 10 has an integral structure and includes a first shaft cover portion 11, a second shaft cover portion 12, a first connecting portion 13 and a second connecting portion 14. The first connecting portion 13 and the second connecting portion 14 are connected between the first shaft cover portion 11 and the second shaft cover portion 12, and are spaced apart axially. The first shaft cover portion 11 is arranged above the first camshaft 20, and the second shaft cover portion 12 is arranged above the second camshaft 30. It should be noted that a traditional camshaft cover generally has a split structure, while the camshaft cover 10 according to the present disclosure has the integral structure, thus achieving a good wholeness and a high structural strength. Further, a mold and a clamp for manufacturing the camshaft cover 10 have less investment, thus reducing an input cost. Moreover, an oil gallery 15 may also be conveniently arranged in the integral camshaft cover 10.

As shown in FIG. 1, at least two shaft holes spaced apart axially are formed in a bottom of the first shaft cover portion 11, the number of the shaft holes may be three, the three shaft holes may be a first shaft hole 111, a second shaft hole 112 and a third shaft hole 113, and the first shaft hole 111, the second shaft hole 112 and the third shaft hole 113 may have the same size. At least two shaft holes spaced apart axially are formed in a bottom of the second shaft cover portion 12, the number of the shaft holes may be three, the three shaft holes may be a fourth shaft hole 121, a fifth shaft hole 122 and a sixth shaft hole 123, and the fourth shaft hole 121, the fifth shaft hole 122 and the sixth shaft hole 123 may have the same size.

The first journal 21 is engaged in the first shaft hole 111, the second journal 22 is engaged in the second shaft hole 112, the third journal 23 is engaged in the third shaft hole 113, the fourth journal 31 is engaged in the fourth shaft hole 121, the fifth journal 32 is engaged in the fifth shaft hole 122, and the sixth journal 33 is engaged in the sixth shaft hole 123. By properly configuring the shaft holes and the journals, the integral camshaft cover 10 can effectively protect and fix the first camshaft 20 and the second camshaft 30, thus guaranteeing the structural reliability of the camshaft assembly 100.

According to an optional embodiment of the present disclosure, as shown in FIGS. 1 and 2, the first connecting portion 13 is connected to an axial end of the first shaft cover portion 11 and an axial end of the second shaft cover portion 12, i.e., the first connecting portion 13 is connected to a left end of the first shaft cover portion 11 and a left end of the second shaft cover portion 12. Since transmission gears need to be arranged to the axial end of the first camshaft 20 and the axial end of the second camshaft 30, the arrangement of the first connecting portion 13 to the axial end of the first shaft cover portion 11 and the axial end of the second shaft cover portion 12 may facilitate a fixed mounting of the first camshaft 20 and the second camshaft 30, and guarantee the transmission stability between the two camshafts and a crankshaft of an engine.

Further, as shown in FIGS. 1 to 4, the oil gallery 15 is arranged in the camshaft cover 10, and oil holes 16 in communication with the oil gallery 15 are provided at the at least two shaft holes. Specifically, the oil holes 16 in communication with the oil gallery 15 are formed at the first shaft hole 111, the second shaft hole 112, the third shaft hole 113, the fourth shaft hole 121, the fifth shaft hole 122 and the sixth shaft hole 123. That is, each shaft hole is correspondingly provided with one oil hole 16, and the oil hole 16 may provide a lubricating oil for the corresponding shaft hole, thereby guaranteeing lubrication of the journals, and then guaranteeing the working reliability of the camshaft assembly 100. The oil gallery 15 may be conveniently arranged in the integral camshaft cover 10, and may supply oil to at least two oil holes 16 at the same time, such that the camshaft cover 10 has a simple structure, and the lubrication of the first camshaft 20 and the second camshaft 30 can be guaranteed. A projection of the oil hole 16 in a plane perpendicular to the camshafts or the camshaft cover 10 may have an arc shape, which matches with a shape of a surface of the corresponding journal, and thus the arc-shaped oil hole 16 may facilitate the oil supply to the surfaces of the journals.

Figure 3:
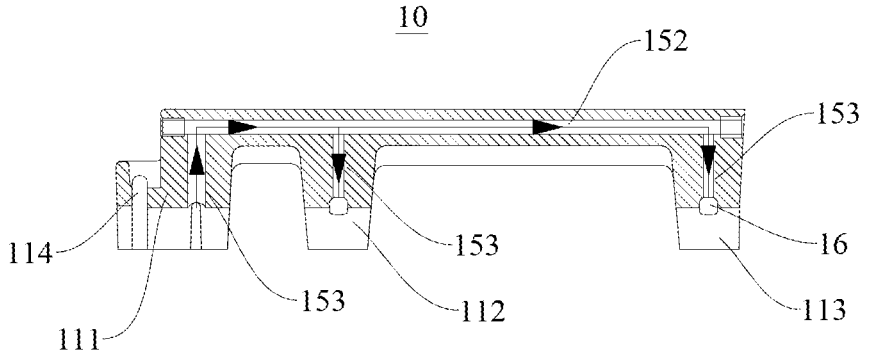
FIG. 3 is a sectional view of a camshaft cover taken at a first shaft cover portion.
Figure 4:
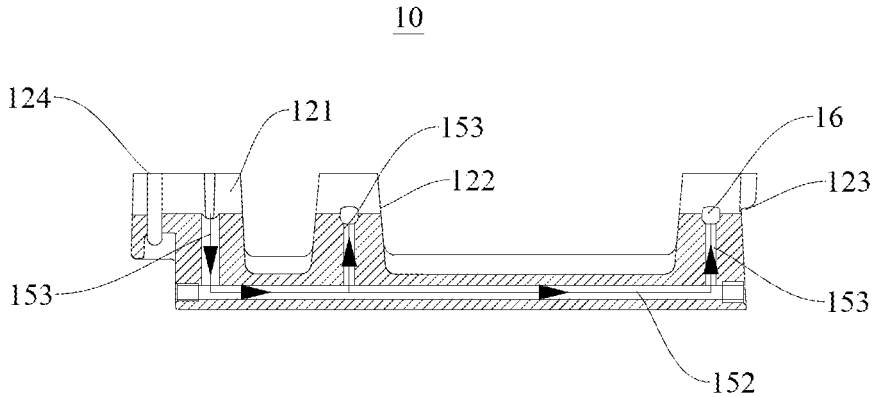
FIG. 4 is a sectional view of a camshaft cover taken at a second shaft cover portion.
Figure 5:
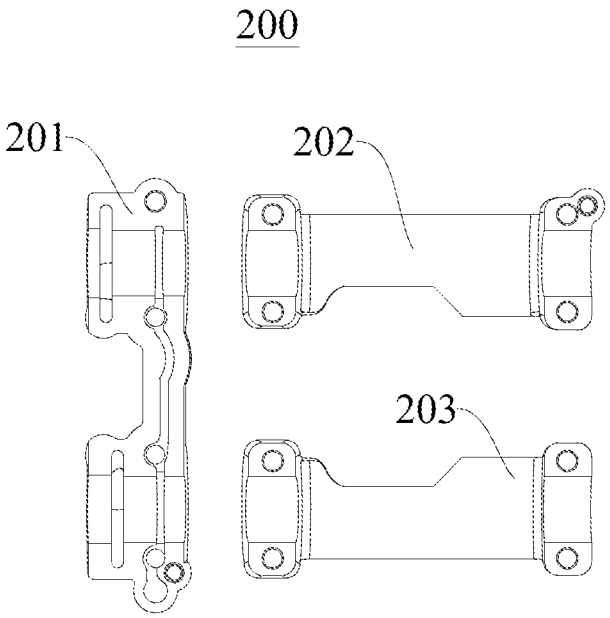
FIG. 5 is a schematic view of a camshaft cover in the related art.

Specifically, as shown in FIGS. 2 to 4, the oil gallery 15 includes a first sub-oil gallery 151, a second sub-oil gallery 152 and a third sub-oil gallery 153, the first sub-oil gallery 151 extends throughout the first shaft cover portion 11, the first connecting portion 13 and the second shaft cover portion 12, and an oil inlet of the first sub-oil gallery 151 may be arranged on a side of the first shaft cover portion 11, so as to facilitate an oil intake. At least two third sub-oil galleries 153 are provided and in communication with the oil holes 16 of at least two corresponding shaft holes. The second sub-oil gallery 152 arranged at the first shaft cover portion 11 is in communication with multiple third sub-oil galleries 153 of the first shaft cover portion 11, and the second sub-oil gallery 152 arranged at the second shaft cover portion 12 is in communication with at least two third sub-oil galleries 153 of the second shaft cover portion 12. The third sub-oil galleries 153 of the first shaft cover portion 11 and the second shaft cover portion 12 adjacent to the first connection portion 13 are communicated with the first sub-oil gallery 151.

Specifically, six third sub-oil galleries 153 are provided and in communication with the six oil holes 16, respectively. The first sub-oil gallery 151 is in direct communication with the third sub-oil gallery 153 located at the first shaft hole 111, and is in direct communication with the third sub-oil gallery 153 located at the fourth shaft hole 121. Two second sub-oil galleries 152 are provided and arranged at the first shaft cover portion 11 and the second shaft cover portion 12, respectively. The second sub-oil gallery 152 arranged at the first shaft cover portion 11 is in communication with the three third sub-oil galleries 153 of the first shaft cover portion 11, and the second sub-oil gallery 152 arranged at the second shaft cover portion 12 is in communication with the three third sub-oil galleries 153 of the second shaft cover portion 12.

It may be understood that after the lubricating oil inside the engine is supplied to the first sub-oil gallery 151, the first sub-oil gallery 151 may supply the oil to the third sub-oil gallery 153 corresponding to the first haft hole 111 and to the third sub-oil gallery 153 corresponding to the fourth shaft hole 121, the third sub-oil gallery 153 at the first shaft hole 111 may supply the oil to the third sub-oil gallery 153 at the second shaft hole 112 and the third sub-oil gallery 153 at the third shaft hole 113 through the second sub-oil gallery 152 in the first shaft cover portion 11, and the third sub-oil gallery 153 at the fourth shaft hole 121 may supply the oil to the third sub-oil gallery 153 at the fifth shaft 122 and the third sub-oil gallery 153 at the sixth shaft hole 123 through the second sub-oil gallery 152 in the second shaft cover portion 12, thereby guaranteeing lubrication of the six journals, and further guaranteeing the lubricating effect of the camshaft assembly 100.

Thus, the integral structure of the camshaft cover 10 may facilitate the arrangement of oil paths, and the oil gallery 15 and the oil hole 16 in communication with each other may be directly formed in the integral camshaft cover 10, which simultaneously meets the lubricating effects between the first camshaft 20 and various parts as well as between the second camshaft 30 and various parts.

In some embodiments, as shown in FIG. 2, the second connecting portion 14 has an end connected between the second shaft hole 112 and the third shaft hole 113 of the first shaft cover portion 11, and another end connected between the fifth shaft hole 122 and the sixth shaft hole 123 of the second shaft cover portion 12. The second connecting portion 14 may have the function of connecting the first shaft cover portion 11 with the second shaft cover portion 12, and the first connecting portion 13 and the second connecting portion 14 are spaced apart axially, such that a closed-loop structure of connection may be formed throughout the first connecting portion 13, the first shaft cover portion 11, the second connecting portion 14 and the second shaft cover portion 12, thereby further improving the structural reliability of the camshaft cover 10.

According to an embodiment of the present disclosure, as shown in FIG. 1, the first camshaft 20 is provided with a first shaft shoulder 24 on a side of the first journal 21 facing away from the second journal 22, and the second camshaft 30 is provided with a second shaft shoulder 34 on a side of the fourth journal 31 facing away from the fifth journal 32. The first shaft cover portion 11 is provided with a first position limiting groove 114, the second shaft cover portion 12 is provided with a second position limiting groove 124, the first shaft shoulder 24 is engaged in the first position limiting groove 114, and the second shaft shoulder 34 is engaged in the second position limiting groove 124. By the engagement of the first shaft shoulder 24 and the first position limiting groove 114 as well as the engagement of the second shaft shoulder 34 and the second position limiting groove 124, the first camshaft 20 and the second camshaft 30 may be limited axially, thereby guaranteeing the axial stability of the first camshaft 20 and the second camshaft 30.

Further, as shown in FIG. 1, the first camshaft 20 is provided with a first flange 25 on a side of the first shaft shoulder 24 facing away from the first journal 21, the first flange 25 and the first shaft shoulder 24 have a spacing B therebetween, the second camshaft 30 is provided with a second flange 35 on a side of the second shaft shoulder 34 facing away from the fourth journal 31, the second flange 35 and the second shaft shoulder 34 have a spacing A therebetween, and $A \neq B$. That is, there exists a fool-proof design between the first camshaft 20 and the second camshaft 30, thereby preventing a misassembling problem, and guaranteeing the reliability of achieving the functions of the engine. In addition, the manner of changing the spacing to prevent misassembling is easy to realize.

Still further, as shown in FIG. 1, the first position limiting groove 114 and the second position limiting groove 124 have an axial spacing C therebetween, and $C=|B-A|$. Thus, in the camshaft assembly 100 according to the present disclosure, on the basis of reasonably designing the two camshafts, the spacing between the two position limiting grooves on the camshafts is also designed reasonably, such that the second shaft shoulder 34 can be just engaged in the second position limiting groove 124 when the first shaft shoulder 24 is just engaged in the first position limiting groove 114, thereby further improving the engagement accuracy and reliability of the camshaft assembly 100. The first position limiting groove 114 and the second position limiting groove 124 may have the same shape and structure.

In some embodiments, as shown in FIGS. 1 and 2, a first position limiting protrusion 115 is provided at an end of the second shaft hole 115 adjacent to the first shaft hole 111, and a second position limiting protrusion 125 is provided at an end of the fifth shaft hole 122 adjacent to the sixth shaft hole 123. The arrangement of the first position limiting protrusion 115 and the second position limiting protrusion 125 may achieve an axial position limiting function, and guarantee the axial engagement stability between the first shaft cover portion 11 and the first camshaft 20, and the axial engagement stability between the second shaft cover portion 12 and the second camshaft 30. In addition, the staggered arrangement of the first position limiting protrusion 115 and the second position limiting protrusion 125 may achieve the function of preventing misassembling at least to some extent, thus further improving the reliability of the camshaft assembly 100.

Specifically, as shown in FIG. 1, the second journal 22 has a first end face adjacent to the first journal 21 and a second end face facing away from the first journal 21, and the fifth journal 32 has a first end face adjacent to the fourth journal 31 and a second end face facing away from the fourth journal 31. The first position limiting protrusion 115 and the first end face of the second journal 22 have a distance F therebetween, and the first position limiting protrusion 115 and the first end face of the fifth journal 32 also have a distance F therebetween. The second position limiting protrusion 125 and the second end face of the second journal 22 have a distance D therebetween, and the second position limiting protrusion 125 and the second end face of the fifth journal 32 also have a distance therebetween. $0<F<C$, and $0<D<C$. The camshaft assembly 100 arranged in this way may further achieve the function of preventing misassembling, thus guaranteeing the assembling accuracy.

Thus, when the first camshaft 20 and the second camshaft 30 are correctly assembled into the camshaft cover 10, that is, when the first shaft shoulder 24 is assembled into the first position limiting groove 114, the first, second and third journals 21, 22, 23 are correspondingly assembled into the first, second and third shaft holes 111, 112, 113, respectively, the second shaft shoulder 34 is assembled into the second position limiting groove 124, and the fourth, fifth and sixth journals 31, 32, 33 are correspondingly assembled into the fourth, fifth and sixth shaft holes 121, 122, 123, respectively. An axial distance between the first end face of the second journal 22 and an end face of the first position limiting protrusions 115 is the distance F, and an axial distance between the second end face of the second journal 22 and an end face of the second position limiting protrusions 125 is the distance D. An axial distance between the first end face of the fifth journal 32 and the end face of the first position limiting protrusion 115 is the distance F, and an axial distance between the second end face of the fifth journal 32 and the end face of the second position limiting protrusion 125 is the distance D. $0<F<C$, $0<D<C$. The camshafts do not interfere with the first position limiting protrusion 115 when working.

When the first shaft shoulder 24 of the first camshaft 20 is to be assembled into the second position limiting groove 124, the first camshaft 20 is axially moved by a distance C in a direction from the third journal 23 to the first journal 21, in which $0<D<C$. and hence the second end face of the second journal 22 will interfere with the second position limiting protrusion 125 during assembling, thus effectively preventing misassembling of the first camshaft 20.

When the second shaft shoulder 34 of the second camshaft 30 is to be assembled into the first position limiting groove 114, the second camshaft 30 is axially moved by a distance C in a direction from the fourth journal 31 to the sixth journal 33, in which $0<F<C$, and hence the first end face of the fifth journal 32 will interfere with the first position limiting protrusion 115 during assembling, thus effectively preventing misassembling of the second camshaft 30.

A double-cylinder engine according to an embodiment of the present disclosure includes the camshaft assembly 100 according to the above embodiments.

An all-terrain vehicle according to an embodiment of the present disclosure includes the double-cylinder engine according to the above embodiment.

In the descriptions of the present disclosure, it is to be understood that terms such as "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial", and "circumferential" should be construed to refer to the orientation and position as shown in the drawings. These relative terms are for convenience of descriptions and do not indicate or imply that the device or element must be constructed or operated in a particular orientation, thus cannot be construed to limit the present disclosure.

In the descriptions of the present disclosure, the feature defined with "first" and "second" may include one or more of this feature. In the descriptions of the present disclosure, "a plurality of" means two or more. In the descriptions of the present disclosure, a structure in which a first feature is "on" or "below" a second feature may include an embodiment in which the first feature is in direct contact with the second feature, and may also include an embodiment in which the first feature and the second feature are not in direct contact but contacted via an additional feature formed therebetween. In the descriptions of the present disclosure, a first feature being "on," "above," or "on top of" a second feature may include an embodiment in which the first feature is right or obliquely "on," "above," or "on top of" the second feature, or just means that the first feature is at a height higher than that of the second feature.

In the descriptions of the present specification, reference throughout this specification to "an embodiment", "some embodiments", "illustrative embodiment", "example", "specific example" or "some examples" means that a particular feature, structure, material, or characteristic described in connection with the embodiment or example is included in at least one embodiment or example of the present disclosure. In the specification, the schematic expressions related to the above terms do not necessarily refer to the same embodiment or example.

Although embodiments of the present disclosure have been shown and illustrated, it shall be understood by those skilled in the art that various changes, modifications, alternatives and variants can be made without departing from the principle and idea of the present disclosure. The scope of the present disclosure is defined by claims and their equivalents.

What is claimed is:

1. A camshaft assembly for a double-cylinder engine, comprising:

a first camshaft having an axis;

a second camshaft having an axis parallel to the axis of the first camshaft; and a camshaft cover, comprising a first shaft cover portion, a second shaft cover portion, a first connecting portion and a second connecting portion which are integrally formed, the first connecting portion and the second connecting portion being spaced apart axially, and connected between the first shaft cover portion and the second shaft cover portion, wherein the first shaft cover portion covers the first camshaft, and the second shaft cover portion covers the second camshaft, wherein the first camshaft has a first journal, a second journal and a third journal spaced apart axially, and the second camshaft has a fourth journal, a fifth journal and a sixth journal spaced apart axially;

the first camshaft is provided with a first shaft shoulder on a side of the first journal facing away from the second journal, and the second camshaft is provided with a second shaft shoulder on a side of the fourth journal facing away from the fifth journal; and the first shaft cover portion is provided with a first position limiting groove, the second shaft cover portion is provided with a second position limiting groove, the first shaft shoulder is engaged in the first position limiting groove, and the second shaft shoulder is engaged in the second position limiting groove, wherein the first camshaft is provided with a first flange on a side of the first shaft shoulder facing away from the first journal, and the first flange and the first shaft shoulder have a spacing denoted as B therebetween; and the second camshaft is provided with a second flange on a side of the second shaft shoulder facing away from the fourth journal, the second flange and the second shaft shoulder have a spacing denoted as A therebetween, and $A \neq B$.

2. The camshaft assembly according to claim 1, wherein the first position limiting groove and the second position limiting groove have an axial spacing denoted as C therebetween, and $C=|B-A|$.

3. The camshaft assembly according to claim 2, wherein a first shaft hole, a second shaft hole and a third shaft hole spaced apart axially are formed in a bottom of the first shaft cover portion, a fourth shaft hole, a fifth shaft hole and a sixth shaft hole spaced apart axially are formed in a bottom of the second shaft cover portion;

the first journal is engaged in the first shaft hole, the second journal is engaged in the second shaft hole, the third journal is engaged in the third shaft hole, the fourth journal is engaged in the fourth shaft hole, the fifth journal is engaged in the fifth shaft hole, the sixth journal is engaged in the sixth shaft hole; and a first position limiting protrusion is provided at an end of the second shaft hole adjacent to the first shaft hole, and a second position limiting protrusion is provided at an end of the fifth shaft hole adjacent to the sixth shaft hole.

4. The camshaft assembly according to claim 3, wherein the second journal has a first end face adjacent to the first journal and a second end face facing away from the first journal;

the fifth journal has a first end face adjacent to the fourth journal and a second end face facing away from the fourth journal;

the first position limiting protrusion and the first end face of the second journal have a distance denoted as F therebetween, and the first position limiting protrusion and the first end face of the fifth journal also have a distance denoted as F therebetween, the distances denoted as F are the same; and the second position limiting protrusion and the second end face of the second journal have a distance denoted as D therebetween, and the second position limiting protrusion and the second end face of the fifth journal also have a distance denoted as D therebetween, the distances denoted as D are the same, wherein $0<F<C$, and $0<D<C$.

5. The camshaft assembly according to claim 1, wherein the first connecting portion is connected to an axial end of the first shaft cover portion and an axial end of the second shaft cover portion.

6. The camshaft assembly according to claim 5, wherein an oil gallery is arranged in the camshaft cover, each of a bottom of the first shaft cover portion and a bottom of the second shaft cover portion is provided with at least two shaft holes spaced apart axially, and oil holes in communication with the oil gallery are formed at the at least two shaft holes, respectively.

7. The camshaft assembly according to claim 6, wherein the at least two shaft holes of the first shaft cover portion comprise a first shaft hole, a second shaft hole and a third shaft hole spaced apart axially in the bottom of the first shaft cover portion;

the at least two shaft holes of the second shaft cover portion comprise a fourth shaft hole, a fifth shaft hole and a sixth shaft hole spaced apart axially in the bottom of the second shaft cover portion; and the oil holes comprise six oil holes in communication with the oil gallery at the first shaft hole, the second shaft hole, the third shaft hole, the fourth shaft hole, the fifth shaft hole and the sixth shaft hole, respectively.

8. The camshaft assembly according to claim 7, wherein the oil gallery comprises a first sub-oil gallery, two second sub-oil galleries and six third sub-oil galleries;

the first sub-oil gallery extends throughout the first shaft cover portion, the first connecting portion and the second shaft cover portion;

the six third sub-oil galleries are provided and in communication with the six oil holes respectively, the first sub-oil gallery is in direct communication with the third sub-oil gallery arranged at the first shaft hole and the third sub-oil gallery arranged at the fourth shaft hole; and the two second sub-oil galleries are provided and arranged in the first shaft cover portion and the second shaft cover portion respectively, the second sub-oil gallery arranged in the first shaft cover portion is in communication with three of the six third sub-oil galleries in the first shaft cover portion, and the second sub-oil gallery arranged in the second shaft cover portion is in communication with another of a three of the six third sub-oil galleries in the second shaft cover portion.

9. The camshaft assembly according to claim 8, wherein the second connecting portion has an end connected between the second shaft hole and the third shaft hole of the first shaft cover portion, and another end connected between the fifth shaft hole and the sixth shaft hole of the second shaft cover portion.

10. A double-cylinder engine, comprising a camshaft assembly, the camshaft assembly comprising:

a first camshaft having an axis;

a second camshaft having an axis parallel to the axis of the first camshaft; and a camshaft cover having an integral structure, and comprising a first shaft cover portion, a second shaft cover portion, a first connecting portion and a second connecting portion, the first connecting portion and the second connecting portion being connected between the first shaft cover portion and the second shaft cover portion, and spaced apart axially, wherein the first shaft cover portion covers the first camshaft, and the second shaft cover portion covers the second camshaft, wherein the first camshaft has a first journal, a second journal and a third journal spaced apart axially, and the second camshaft has a fourth journal, a fifth journal and a sixth journal spaced apart axially:

the first camshaft is provided with a first shaft shoulder on a side of the first journal facing away from the second journal, and the second camshaft is provided with a second shaft shoulder on a side of the fourth journal facing away from the fifth journal; and the first shaft cover portion is provided with a first position limiting groove, the second shaft cover portion is provided with a second position limiting groove, the first shaft shoulder is engaged in the first position limiting groove, and the second shaft shoulder is engaged in the second position limiting groove, wherein the first camshaft is provided with a first flange on a side of the first shaft shoulder facing away from the first journal, and the first flange and the first shaft shoulder have a spacing denoted as B therebetween; and the second camshaft is provided with a second flange on a side of the second shaft shoulder facing away from the fourth journal, the second flange and the second shaft shoulder have a spacing denoted as A therebetween, and $A \neq B$.

11. The double-cylinder engine according to claim 10, wherein an oil gallery is arranged in the camshaft cover, each of a bottom of the first shaft cover portion and a bottom of the second shaft cover portion is provided with at least two shaft holes spaced apart axially, and oil holes in communication with the oil gallery are formed at the at least two shaft holes, respectively.

12. The double-cylinder engine according to claim 11, wherein the at least two shaft holes of the first shaft cover portion comprise a first shaft hole, a second shaft hole and a third shaft hole spaced apart axially in the bottom of the first shaft cover portion;

the at least two shaft holes of the second shaft cover portion comprise a fourth shaft hole, a fifth shaft hole and a sixth shaft hole spaced apart axially in the bottom of the second shaft cover portion; and the oil holes comprise six oil holes in communication with the oil gallery at the first shaft hole, the second shaft hole, the third shaft hole, the fourth shaft hole, the fifth shaft hole and the sixth shaft hole, respective.

* * * * *